US008487186B2

(12) United States Patent
Walid

(10) Patent No.: US 8,487,186 B2
(45) Date of Patent: Jul. 16, 2013

(54) FLAT POWER CABLE

(75) Inventor: El-fityani Walid, Milan (IT)

(73) Assignee: Prysmian S.p.A., Milan (IT)

( * ) Notice: Subject to any disclaimer, the term of this patent is extended or adjusted under 35 U.S.C. 154(b) by 281 days.

(21) Appl. No.: 12/811,432

(22) PCT Filed: Jan. 11, 2008

(86) PCT No.: PCT/IT2008/000019
§ 371 (c)(1),
(2), (4) Date: Oct. 4, 2010

(87) PCT Pub. No.: WO2009/087696
PCT Pub. Date: Jul. 16, 2009

(65) Prior Publication Data

US 2011/0011617 A1 Jan. 20, 2011

(51) Int. Cl.
*H01B 7/00* (2006.01)

(52) U.S. Cl.
USPC ..... 174/110 R; 174/113 R; 174/116; 174/117 R; 174/117 F

(58) Field of Classification Search
USPC ..... 174/102 R, 110 AR, 120 R, 121 SR, 174/121 R, 113 R
See application file for complete search history.

(56) References Cited

U.S. PATENT DOCUMENTS

| | | | | |
|---|---|---|---|---|
| 1,668,699 | A * | 5/1928 | Saylor | 174/117 R |
| 3,800,066 | A | 3/1974 | Whitfill et al. | |
| 3,889,049 | A | 6/1975 | Legg et al. | |
| 4,600,805 | A * | 7/1986 | Glynn et al. | 174/102 R |
| 4,913,517 | A * | 4/1990 | Arroyo et al. | 385/107 |
| 5,179,251 | A * | 1/1993 | Mullin et al. | 174/23 C |
| 6,528,730 | B2 * | 3/2003 | Persson | 174/116 |
| 7,009,113 | B2 | 3/2006 | Varkey | |
| 7,297,873 | B2 * | 11/2007 | Grogl | 174/121 A |
| 7,411,132 | B1 * | 8/2008 | Medling | 174/113 R |
| 2007/0027245 | A1 | 2/2007 | Vaidya et al. | |
| 2008/0253723 | A1 * | 10/2008 | Stokes et al. | 385/114 |

FOREIGN PATENT DOCUMENTS

| | | |
|---|---|---|
| DE | 43 35 147 A1 | 4/1995 |
| RU | 2173900 C1 | 9/2001 |
| RU | 2212722 C2 | 9/2003 |
| RU | 46123 U1 | 6/2005 |

OTHER PUBLICATIONS

International Search Report from the European Patent Office for International Application No. PCT/IT2008/000019 (Mail date Sep. 17, 2008).

* cited by examiner

*Primary Examiner* — William H Mayo, III
(74) *Attorney, Agent, or Firm* — Finnegan, Henderson, Farabow, Garrett & Dunner, L.L.P.

(57) ABSTRACT

A flat power cable includes at least two cores of which at least two cores include a power transmissive insulated element and a protective sheath disposed in a radially external position with respect to the power transmissive insulated element. The cores are disposed on a common transversal axis and an outer armour contains the cores. Inside the armour, adjacent cores and an internal surface of the armour delimit empty interstitial spaces. The flat cable includes swellable fillers disposed in the empty interstitial spaces. In a transversal section of the cable, each of the swellable fillers, in an unswelled configuration, presents a cross section area smaller than a cross section area of the respective empty interstitial space. The swellable fillers swell by absorbing fluid the flat power cable is submerged in and enlarge, filling all the interstices, pushing against the cores and the armour and constraining the cable in its flat configuration.

24 Claims, 4 Drawing Sheets

FLAT POWER CABLE

CROSS REFERENCE TO RELATED APPLICATION

This application is a national phase application based on PCT/IT2008/000019, filed Jan. 11, 2008, the content of which is incorporated herein by reference.

BACKGROUND OF THE INVENTION

1. Field of the Invention

The present invention relates to a flat power cable. The power cable should have adequate current carrying capability and sufficient dielectric strength to minimize electrical losses and failures even under the adverse environmental conditions.

2. Description of Related Art

U.S. Pat. No. 3,889,049, for example, teaches of the conditions within a well. The environmental conditions of the well vary generally depending upon geographical location. In some cases the well fluid is highly corrosive and in many instances well temperatures exceed 275° F. (about 135° C.). Most oil well fluids include brines containing dissolved $H_2S$ gas, carbonates and salts, and large volumes of oil. The fluid pressure in wells may be quite high and in many instances exceeds 4,000 psig (about 270 atm). Additionally, the wells are quite deep, averaging 8,000 to 10,000 feet (about 2 to 3 km). The electrical cable must possess sufficient physical strength to allow insertion of the motor and cable to these depths and the outer surface of the cable must resist the abrasion associated with insertion.

Among these applications there are flat submersible electrical cables used to convey electric energy to submersible appliances (i.e. motors) for use in oil, mineral or water wells. The flat shape of these cables allows the passage of the same through narrow ways in oil wells or relatively small diameter, where a larger round cable might cause interference or other problems, as taught, for example, by U.S. Pat. No. 4,600,805.

An example of flat cable used in hostile environment is marketed by the Applicant with the tradename Devilead® Flat Pump Cable. Such cable has three conductors insulated with an EPDM (ethylene propylene diene monomer) based compound. Each insulated conductor is coated by a lead sheath. A lapped steel tape armour encircles the three insulated and sheathed conductors. The presence of said lead-sheath protects the cable insulated conductors against oil, chemicals and gases, and insulation decompression, but also increases the cable weight.

A lighter cable is, for example, marketed by the Applicant with the tradename Deviline® Flat Cable wherein each of the three conductors, insulated by a polypropylene based layer, is protected by a polymeric sheath (based for example, on ethylene propylene diene monomer rubber, EPDM). In turn, the polymeric sheath is helically overlapped with fluoropolymer tape (for example of polytetrafluorethylene PTFE). A lapped steel tape armour encircles the three insulated and sheathed conductors. The combination polymeric sheath/fluoropolymer tape provide the insulated conductors with protection against heat, oil, chemicals and decompression.

The Applicant observed that in high temperature, gas/oil environment or because of change, in pressure, the polymeric sheath tends to swell or enlarge into the interstitial empty spaces under the armour, possibly causing a disarrangement of tapes or braids surrounding the sheath and/or impairing the cable geometry, both the outcomes eventually leading to cable failure. The swelling of the polymeric sheath and the disarrangement of tapes can make the insulated conductors moving one with respect to the other. Under such circumstances, the insulated cores lose their configuration—a highly undesirable occurrence—and this eventually leads to cable failures.

U.S. Pat. No. 7,009,113 deals with a high temperature electrical cable having an interstitial filler and with the problem of improving the roundness of the cable. The electrical cable includes a central insulated conductor and a plurality of outer insulated conductors disposed around the central insulated conductor, the central insulated conductor and the plurality of outer insulated conductors forming a first set of interstices therebetween and the plurality of outer insulated conductors forming a second set of interstices therebetween. The electrical cable further includes a filler material substantially filling at least a portion of the first set of interstices and at least a portion of the second set of interstices and a jacket encasing the conductors and the filler material. Filler material such as a ceramic putty, a fluoroelastomer, and/or a fluorinated grease or oil are exemplified. The electrical cable further includes a yarn strand disposed in at least one of the second set of interstices, a filler material substantially filling at least a portion of the first set of interstices and substantially filling at least a portion of the second set of interstices around the yarn, and a tape layer encasing the conductors, the yarn, and the filler material. In one embodiment, the yarn strand comprises tetrafluoroethylene.

US 2007/0027245 relates generally to the field of oilfield exploration, production, and testing, and more specifically to swellable elastomeric materials and their uses in such ventures. In particular, it describes an apparatus comprising a swellable elastomeric composition with peculiar chemical characteristics. Such apparatus includes those wherein the oilfield element may be any element exposed to water, brine, low and high pH fluids, and/or hydrocarbon fluids, such as, inter alia, seals and insulators used in electrical components, such as wire and cable semiconducting shielding and/or jacketing, power cable coverings.

Another problem faced in the operation of cables positioned in the described hostile environment arise from the presence of low molecular weight hydrocarbons such as methane gas, as disclosed, for example, by U.S. Pat. No. 3,800,066. In the depths of the borehole and at temperatures above 150°, which is quite common, the as can permeate the matrix of the cable due to a phenomenon that may be called activated diffusion.

SUMMARY OF THE INVENTION

The Applicant experienced that the cable of the prior art adopt complex and/or heavy structures for ensuring the cable performance in a hostile environment.

The weight of the known cables increases also the costs for transportation and the time needed for the installation in the wellbores.

The Applicant aimed at reducing the weight and the complexity of the known flat cables assuring at the same time the stability of their flat geometry both during the transportation and inside the well, when submerged into the above mentioned fluids, while maintaining an effective protection against chemicals and hostile environment (high temperature and pressure).

The Applicant found that the adoption of swellable fillers placed inside the interstitial spaces between the cores and having, in an unswelled configuration, a cross section area smaller than that of said spaces could maintain the position of one core with respect to the others, assuring the stability of the geometrical flat configuration.

Before the installation of the flat cable according to the invention inside the well and before the submersion of said cable into the well fluids, the swellable fillers fills only part of the space available inside the interstices. In view of the limited amount of material of the fillers, the weight and the stiffness of the flat cable during transportation and before installation is reduced with respect to the known cables of prior art.

After the installation of the flat cable inside the well, when said cable comes into contact with the well fluids and when said fluids seep through the armour, they are absorbed by the swellable fillers. The swellable fillers swell and enlarge, fill all the interstices and push against the cores and the armour, containing and maintaining the cable in its original configuration.

Therefore, in a first aspect, the present invention relates to a flat cable comprising at least two cores of which at least two of said cores comprise a power transmissive insulated element and a protective sheath disposed in radially external position with respect to said power transmissive insulated element; said cores being disposed on a common transversal axis; an outer armour containing said cores; inside said armour, adjacent cores and an internal surface of said armour delimiting empty interstitial spaces; wherein said flat cable comprises swellable fillers disposed in said empty interstitial spaces; wherein, in a transversal section of said cable, each of said swellable fillers in an unswelled configuration presents a cross section area smaller than a cross section area of the respective empty interstitial space.

Preferably, the flat power cable is a submersible cable.

In the present description and claims, as "submersible cable" is meant a power cable used to deliver electricity to submersible motors for use in oil, mineral or water wells.

Preferably, said swellable fillers are made of a composition based on a polymeric material selected from propylene copolymer with a $C_2$-$C_6$ alpha-olefin, for example ethylene-propylene copolymers, optionally in the presence of one or more additional monomer, for example a diene monomer; ethylene copolymer with at least one $C_4$-$C_{14}$ alpha-olefin, optionally in admixture with an ethylene alkylene—or alkyl ester copolymer; and mixture thereof.

The polymeric material can be compounded with additives such as cross-linking agents, plasticizers and inorganic fillers, such as carbon black or kaolin or both.

Preferably, the polymeric material of said swellable fillers has a swelling capacity of from 50% to 400% of the original volume. The swelling capacity must be enough to constrain the cable in its flat configuration.

Preferably, all the swellable fillers have the same swelling capacity. All the swellable fillers enlarge with the same swelling ratio and keep the cable in the flat configuration.

According to a preferred embodiment, the protective sheath is made of a composition based on a polymeric material selected from nitrile rubber, propylene copolymer with a $C_2$-$C_6$ alpha-olefin, preferably ethylene-propylene copolymers, optionally in the presence of one or more additional monomer, for example a diene monomer, and mixtures thereof.

The polymeric material can be compounded with additives such as cross-linking agents, plasticizers and inorganic fillers, such as carbon black or kaolin or both.

Preferably, said swellable fillers have a swelling capacity at least equal to the swelling capacity of the protective sheath.

Otherwise, said swellable fillers have a swelling capacity higher than the swelling capacity of the protective sheath. In this way, the swelling of the fillers opposes the swelling of the protective sheath due to the absorption of the same fluids the flat power cable is submerged in.

According to a preferred embodiment, each of said swellable fillers is a continuous element developing all along the flat cable. The continuity of each element allows to fill every interstice inside the cable and assures homogeneity of the force exerted by the swelled fillers on the cores and on the outer armour all along the cable.

Otherwise, each of said swellable fillers comprises a plurality of discrete elements aligned one after the other all along the flat cable.

Preferably, all of the swellable fillers present the same cross section.

Preferably, all of the swellable fillers have a pay-off thread in an inner portion thereof.

The pay-off thread is preferably based on a material selected from a polyester or a polyamide.

According to a preferred embodiment, each of said swellable fillers presents a circular cross section. Swellable fillers with circular cross section are easy to manufacture and to stock, i.e. wound on reels.

Preferably, each of said swellable fillers in the unswelled configuration lies against the cores and the internal surface.

Advantageously, also in the unswelled configuration, the fillers have a diameter such to block the fillers in the interstices thereof.

According to a preferred embodiment, the flat power cable comprises three power transmissive insulated elements with respective protective sheaths.

According to an embodiment of the invention, one of cores is a control transmissive element.

According to a preferred embodiment, each core comprises a fluoropolymer tape disposed in radially external position with respect to the protective sheath.

Preferably, each core comprises a synthetic braid disposed In radially external position with respect to said fluoropolymer tape.

Alternatively, each core can comprise a fiberglass layer disposed in radially external position with respect to the protective sheath.

Preferably, the ratio between the cross section area of each filler in the unswelled configuration and the cross section area of the respective interstitial space is comprised between about 0.3 and about 0.8.

According to the present description, as "flat cable" it is intended a cable comprising at least two cores disposed in a mutual planar configuration. All the cores lie parallel in a common plane. In a section of the cable transversal with respect to the lengthwise direction of the same cable, the cores lie centred on a common transversal axis.

In the present description and in the subsequent claims, the term "core" of a flat cable is used to indicate a semi-finished structure comprising a transmissive element, such as an electrical energy conductor, an optical signal transmissive element (e.g. an optical fiber) or a composite element transmitting both electrical energy and optical signals, and at least one electrical isolation or, respectively, at least one containment element (for example a tube, a sheath, a micro sheath or a grooved core), or at least two elements, one of which is an electrical isolation element and one is a containment element, arranged at a radially outer position with respect of the corresponding transmissive element.

In the present description and in the subsequent claims, the term "optical signal transmissive element" is used to indicate any transmission element comprising at least one optical fibre. Such a term identifies both a single optical fibre and a plurality of optical fibres, optionally grouped together to form a bundle of optical fibres or arranged parallel to each other and coated with a common coating to form a ribbon of optical fibres.

In the present description and in the subsequent claims, the term "combined electro-optical transmissive element" is used to indicate any element or combination of elements capable of transmitting both electrical energy and optical signals in accordance with the abovementioned definitions.

When a plurality of cores are present in a cable, the cable can be referred to as "bipolar cable", "tripolar cable" and "multipolar cable" depending on the number of cores incorporated therein (in the mentioned cases in number of two, three or greater, respectively).

In accordance with such definitions, the present invention refers to flat cables provided with two or more cores. According to the present invention, at least two of such cores comprise each a power transmissive element. The present invention refers to bipolar or multipolar flat cables of the electric type for transporting or distributing electrical power energy.

As an illustrative example, we consider a cable for transporting or distributing medium voltage electrical energy (where low voltage indicates a voltage lower than 1 kV, whereas medium voltage indicates a voltage of from 1 kV to 35 kV).

In addition to the cores with power transmissive elements, the flat cables of the present invention may comprise one or more cores of the optical type comprising at least one optical fibre, of the electrical type for the transmission of signals or of the combined electro-optical type.

For the purpose of the present description and of the claims which follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

Further features and advantages will become more apparent from the detailed description of some preferred, but not exclusive, embodiments of a cable, as well as from a method for manufacturing a cable, in accordance with the present invention.

BRIEF DESCRIPTION OF THE DRAWINGS

This description will be set out hereinafter with reference to the accompanying drawings in which.

DETAILED DESCRIPTION OF THE INVENTION

Figure 1:
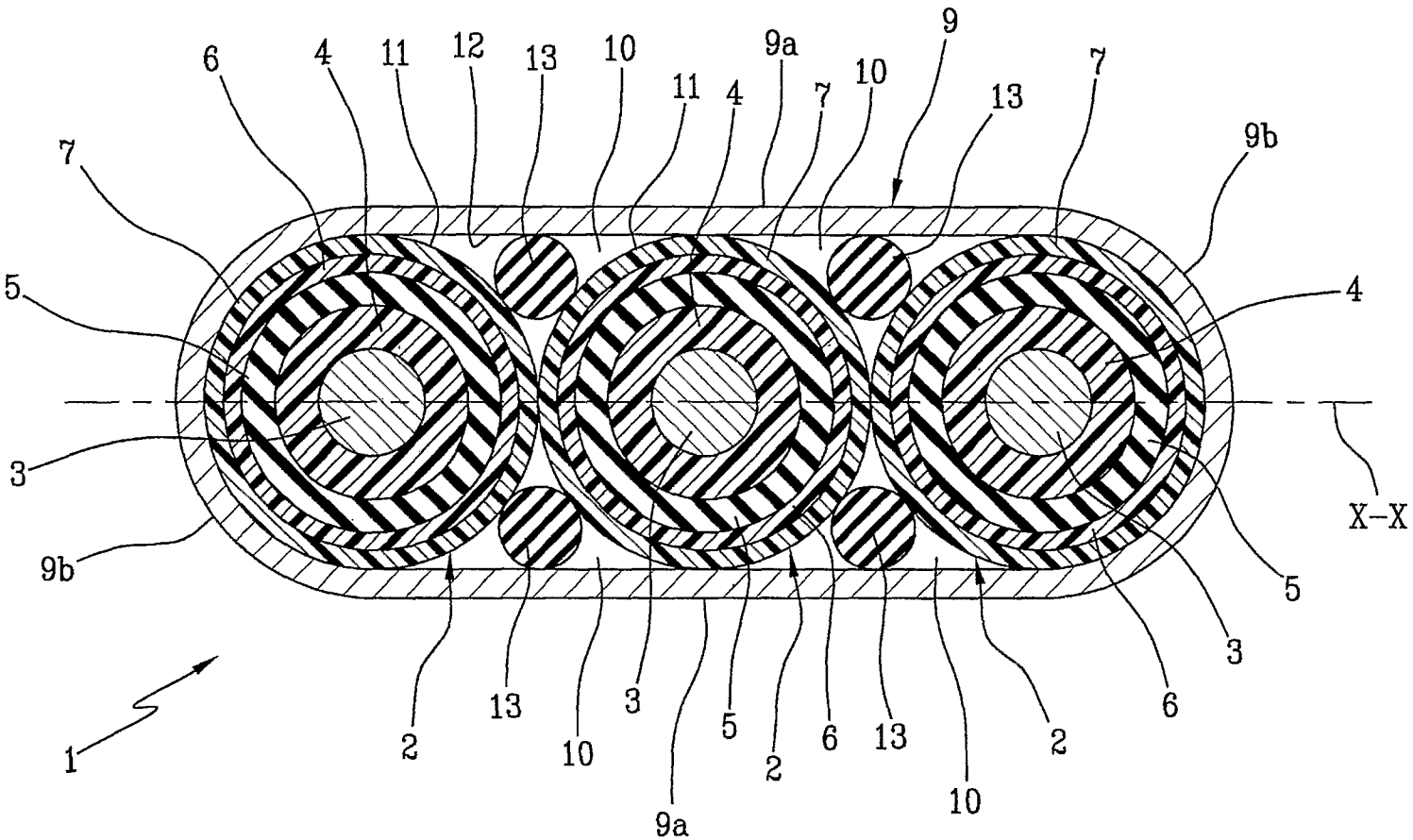
FIG. 1 shows in cross section a cable according to an embodiment of the invention.

With reference to the attached drawings, a flat cable in accordance with the present invention is generally identified by reference numeral 1.

The flat cable 1 comprises cores 2, each of which cores 2 presents one power transmissive element 3. Referring to the attached figures, each core 2 is schematically represented and comprises one transmissive element 3 and an insulating layer 4 provided to surround said transmissive element 3.

In particular, the embodiments of the attached figures present three cores 2, each of which is an electrical power conductor of an AC power submersible flat cable. The present invention could deal with bi-polar or multi-polar flat cables 1, too.

The illustrated transmissive elements 3 are electrical conductors made of metal wires, for example copper, tinned copper or annealed tinned copper, stranded together according to conventional techniques or made of a single solid conductor.

The cable according to the present invention can comprise further cores 2 with different transmissive elements too, such as optical transmissive elements or combined electro-optical transmissive elements (not shown).

In an embodiment not shown, the flat cable 1 comprises three transmissive elements 3 of an AC power supply and one conductor for the control of diagnostic instrumentation, for a total number of four parallel cores 2.

Independently from the kind and of the number of cores 2, such cores 2 are disposed in a mutual planar configuration. All the cores lie parallel in a common plane and adjacent one to the other. In a section of the cable transversal with respect to the lengthwise direction of the same cable, the cores lies centred on a common transversal axis "X-X".

Each core 2 is also provided with a sheath 5 which protect the insulating layer 4 against chemical attack. The protective sheath 5 is disposed in radially external position with respect to said transmissive insulated element 3, 4.

Figure 2:
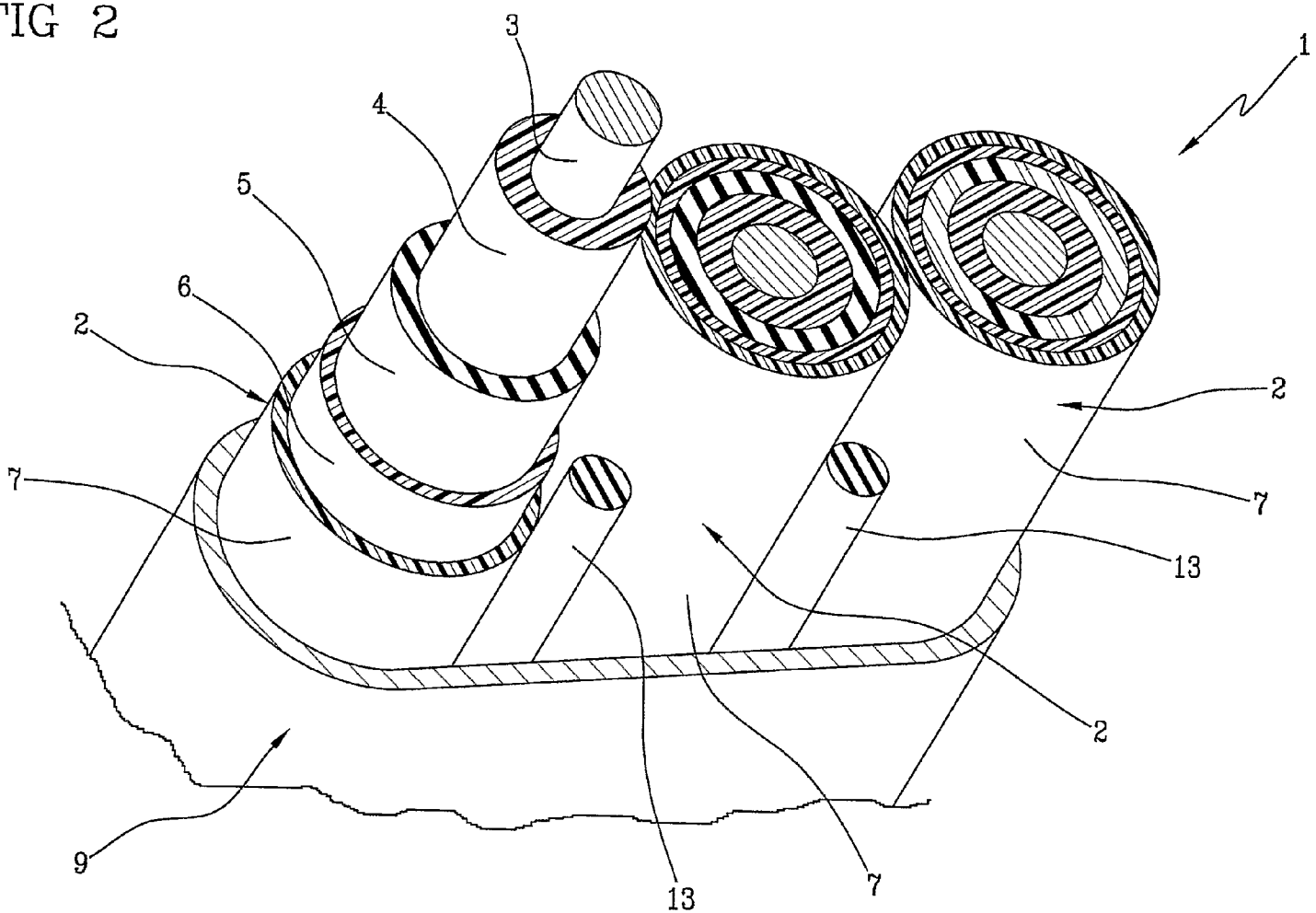
FIG. 2 shows a perspective view of a length of the cable of FIG. 1, with parts removed in order to reveal its structure.

According to the embodiment of FIGS. 1 and 2, said protective sheath 5 comprises a sheath of polymeric material. For example, a protective sheath 5 based on cross-linked Nordel 4770 (EPDM marketed by The Dow Chemical Company) has a swelling of about 70% after treatment in mineral oil at 150° C. for 168 hours.

Around the protective sheath 5 is disposed a tape.

According to the embodiment of FIGS. 1 and 2, each core 2 comprises a fluoropolymer tape 6 (for example in polytetrafluoroethylene, PTFE) disposed in radially external position with respect to the protection sheath 5. A synthetic braid 7 is disposed in radially external position with respect to said fluoropolymer tape 6.

Figure 4:
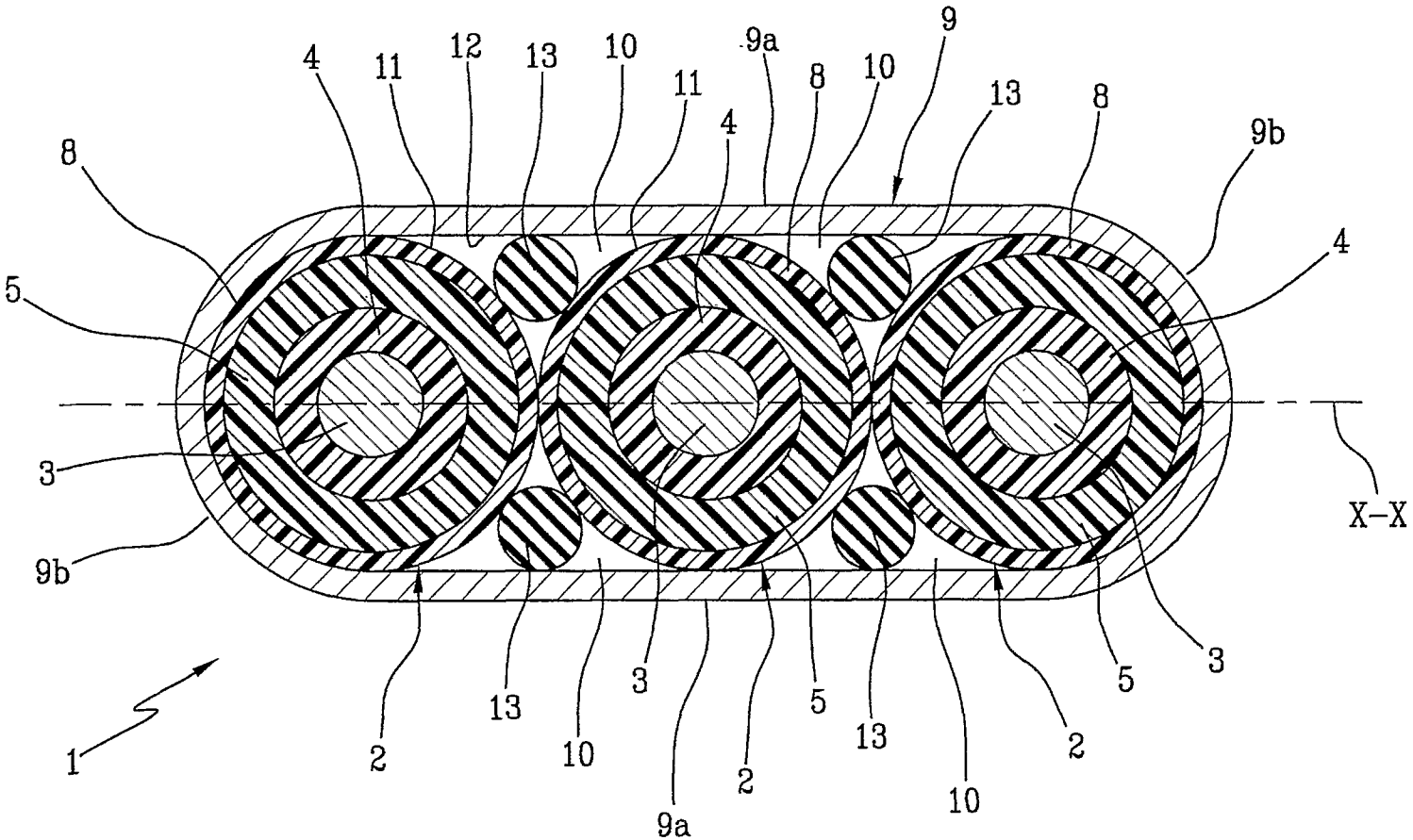
FIG. 4 shows in cross section a cable according to a second embodiment of the invention.

According to the embodiment of FIG. 4, each core 2 comprises a fiberglass layer 8 disposed in radially external position with respect to the protection sheath 5.

The flat cable 1 according to the invention further comprises an outer armour 9 disposed in an external position with respect to said cores 2. Such outer armour 9 presents two substantially flat sides **9*a* parallel to the above cited common plane and two opposite rounded sides 9*b* surrounding a portion of two lateral cores 2. The outer armour 9** is preferably a tape armour of steel or of stainless steel or of a copper and nickel alloy.

As a result of its structure, the flat cable 1 has a plurality of interstitial spaces 10 which are defined by the empty spaces comprised among the cores 2 and the outer armour 9. Two adjacent cores 2 are in contact along a longitudinal zone intersected by the common transversal axis "X-X" and on each side of said common transversal axis "X-X" a substantial triangular interstitial space 10 is defined. In particular, each interstitial space 10 is delimited by a lateral curved surface 11 of each of the two adjacent cores 2 and by a flat portion of an internal surface 12 of the outer armour 9. Each interstitial space 10 extends all along the-flat cable 1.

The flat cable 1 according to the invention further comprises swellable fillers 13 which are disposed in said interstitial spaces 10. In a transversal section of said cable 1, each of said swellable fillers 13 in an unswelled configuration presents a cross section area smaller than the cross section area of the respective interstitial space 10 and, for this reason, does not completely fill such space 10 (FIGS. 1, 2 and 4). Preferably, all the swellable fillers 13 have a cross section with the same shape and dimensions.

In the embodiment shown in the attached figures, each swellable filler 13 presents a circular cross section in contact with each of the lateral curved surfaces 11 of the cores 2 and with the internal surface 12 of the outer armour 9. On the sides of the circular swellable filler 13, in the unswelled configuration, three empty spaces are present, each of substantial triangular shape.

The shape of the cross section of the swellable fillers 13 is not limiting but such shape and/or the dimension of the cross section must be such that the swellable filler 13 in the unswelled configuration only partly fills the respective interstitial space 10.

Preferably, the ratio between the cross section area of each filler 13 in the unswelled configuration and the cross section area of the respective interstitial space 10 is comprised between about 0.3 and about 0.8.

According to one embodiment, each swellable filler 13 develops along the flat cable 1 as a continuous element preferably with a constant cross section. In an alternative embodiment, each swellable filler 13 comprises a plurality of discrete elements aligned one after the other all along the flat cable 1.

In the present description and in the subsequent claims, with the term "swelling capacity", referred to the filler, it is meant that the filler swells after soaking in a fluid of the type cited above in a percentage measured with respect to an original unswelled volume.

Figure 3:
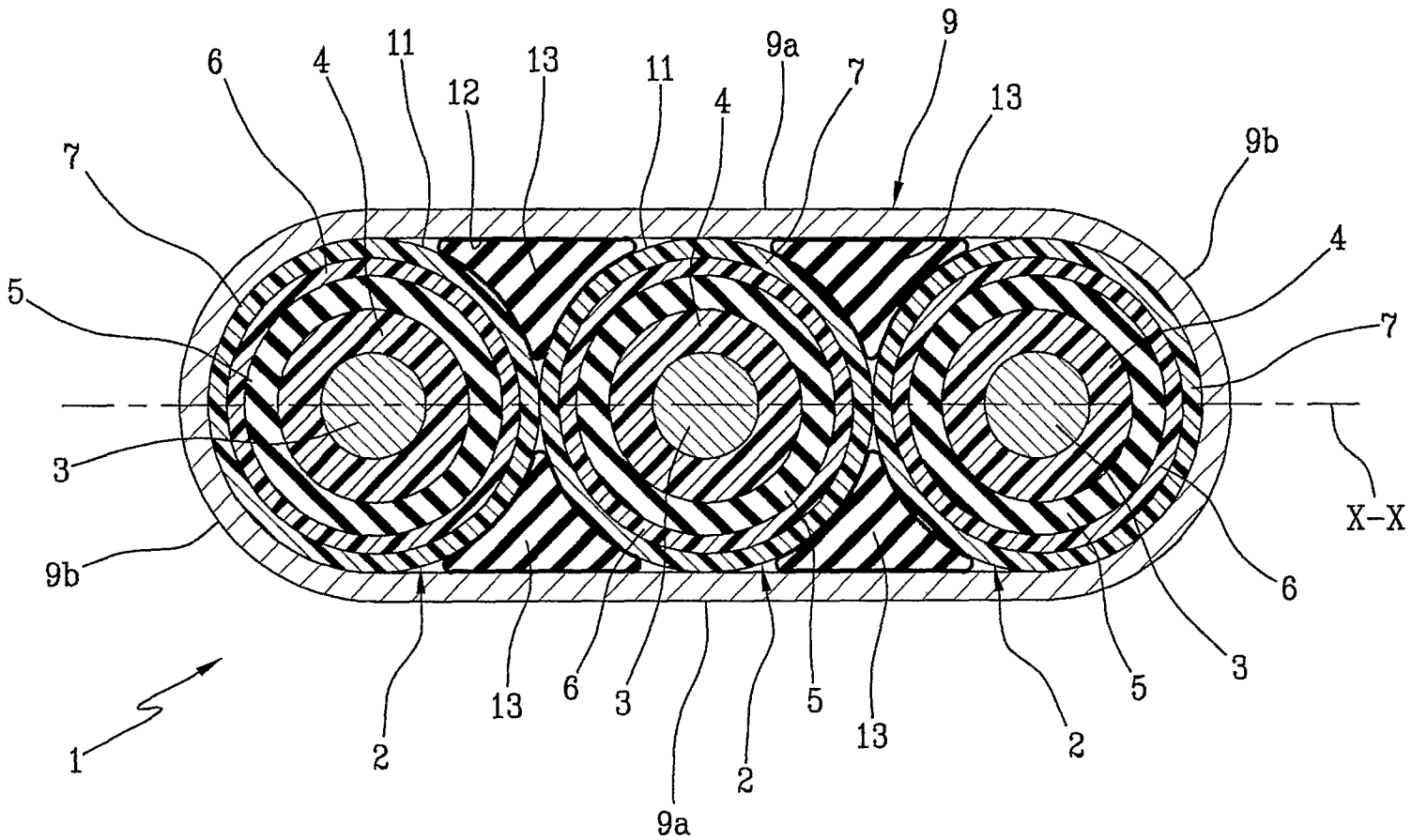
FIG. 3 shows in cross section the cable of FIG. 1 with swelled fillers.

Preferably, each swellable filler 13 presents a swelling capacity comprised between 50% and 400%. Preferably, all the swellable fillers 13 present the same swelling capacity. Apart from the specific value of the swelling capacity, each swellable filler 13 swells after soaking in the cited fluids of the well so that, in the swelled configuration, completely fills the respective empty interstitial space 10 and urges against the outer armour 9 and the cores 2, so that the action of all the swellable fillers 13 constrains the cable 1 in the flat configuration (FIG. 3).

In particular, the swellable fillers 13 contrast also the swelling of the protection sheath 5 soaked into the same well fluids. To this end, preferably, the swelling capacity of the swellable fillers 13 is at least equal or preferably higher than the swelling capacity of the protection sheath 5.

Each swellable filler 13 is made of a polymeric material. For example, a swellable filler 13 based on cross-linked ethylene-octene copolymer/ethylene vinyl acetate copolymer has a swelling of about 200% after treatment in mineral oil at 150° C. for 168 hours.

In order to manufacture the flat cable 1 of the invention, according to a first step of the method of the invention, the cores 2 are prepared according to a pre-selected configuration, per se commonly known.

The swellable filler 13 are preferably prepared by extrusion in form of continuous elements. Preferably, each continuous element is extruded around a pay-off thread so that all of the swellable fillers have a pay-off thread in an inner portion thereof. Preferably, the pay-off thread is based on a material selected from a polyester or a polyamide.

An armour 9 is provided around the cores 2 and the swellable filler 13. Preferably, an armour steel tape is helicoidally wrapped around the cores 2 and the swellable filler 13 provided together to a coiling machine.

The invention claimed is:

1. A flat power cable comprising:

two or more cores of which at least two of said cores comprise a power transmissive insulated element and a protective sheath disposed in a radially external position with respect to said power transmissive insulated element, said cores being disposed on a common transversal axis;

an outer armour containing said cores; and inside said armour, adjacent cores and an internal surface of said armour delimiting interstitial spaces, wherein said flat cable comprises swellable fillers disposed in said interstitial spaces, wherein, in a transversal section of said cable, each of said swellable fillers in an unswelled configuration has a cross section area smaller than a cross section area of the respective interstitial space, and wherein in a swelled configuration, each of said swellable fillers fills the respective interstitial space and urges against the outer armour and the cores such that the cable is constrained in the flat configuration.

2. The flat power cable according to claim 1, comprising a submersible cable.

3. The flat power cable according to claim 1, wherein said swellable fillers swell by absorbing fluids the flat power cable is submerged in.

4. The flat power cable according to claim 1, wherein said swellable fillers are made of a composition comprising a propylene polymeric material.

5. The flat power cable according to claim 4, wherein the propylene polymeric material is selected from polypropylene-ethylene copolymer and ethylene propylene diene monomer rubber.

6. The flat power cable according to claim 5, wherein the protective sheath is made of a composition comprising a propylene polymeric material.

7. The flat power cable according to claim 6, wherein the propylene polymeric material of the protective sheath is selected from polypropylene-ethylene copolymer and ethylene propylene diene monomer rubber.

8. The flat power cable according to claim 1, wherein said swellable fillers have a swelling capacity between 50% and 400% of the original volume.

9. The flat power cable according to claim 1, wherein all the swellable fillers have the same swelling capacity.

10. The flat power cable according to claim 5, wherein said swellable fillers have a swelling capacity at least equal to the swelling capacity of the protective sheath.

11. The flat power cable according to claim 1, wherein said swellable fillers have a swelling capacity higher than the swelling capacity of the protective sheath.

12. The flat power cable according to claim 1, wherein each of said swellable fillers is a continuous element extending all along the flat cable.

13. The flat power cable according to claim 1, wherein each of said swellable fillers comprises a plurality of discrete elements aligned one after the other all along the flat cable.

14. The flat power cable according to claim 1, wherein all of the swellable fillers present the same cross section.

15. The flat power cable according to claim 1, wherein all of the swellable fillers have a pay-off thread in an inner portion thereof.

16. The flat power cable according to claim 15, wherein the pay-off thread comprises a material selected from a polyester or a polyamide.

17. The flat power cable according to claim 1, wherein each of said swellable fillers in the unswelled configuration has a circular cross section.

18. The flat power cable according to claim 1, wherein each of said swellable fillers in the unswelled configuration lies against the cores and the internal surface.

19. The flat power cable according to claim 1, comprising at least three power transmissive insulated elements with respective protective sheaths.

20. The flat power cable according to claim 1, wherein one of said cores is a control transmissive element.

21. The flat power cable according to claim 1, wherein each core comprises a fluoropolymer tape disposed in a radially external position with respect to the protective sheath.

22. The flat power cable according to claim 21, wherein each core comprises a synthetic braid disposed in radially external position with respect to said fluoropolymer tape.

23. The flat power cable according to claim 1, wherein each core comprises a fiberglass tape disposed in a radially external position with respect to the protective sheath.

24. The flat power cable according to claim 1, wherein the ratio between the cross section area of each filler in the unswelled configuration and the cross section area of the respective interstitial space is between about 0.3 and about 0.8.

* * * * *